US005325758A

United States Patent [19]

Compton et al.

[11] Patent Number: 5,325,758

[45] Date of Patent: Jul. 5, 1994

[54] BLANK FIRING ATTACHMENT

[76] Inventors: David W. Compton, 20 Rosebank Crescent, Kitchener, Ontario, Canada N2E 2R4; Thomas Hortobagyi, 6 Ashwood Dr., Cambridge, Ontario, Canada N3C 3H8

[21] Appl. No.: 46,855

[22] Filed: Apr. 16, 1993

[51] Int. Cl.[5] ..... F41A 21/26

[52] U.S. Cl. ..... 89/14.500

[58] Field of Search ..... 89/14.5

[56] References Cited

U.S. PATENT DOCUMENTS

| | | | |
|---|---|---|---|
| 680,327 | 8/1901 | Hoy | 89/14.5 |
| 3,687,000 | 8/1972 | Csizmer et al. | 89/14.5 |
| 3,744,370 | 7/1973 | Snodgrass | 89/14.5 |
| 3,766,822 | 10/1973 | Sophinos | 89/14.5 |
| 4,499,811 | 2/1985 | Kaste | 89/14.5 |

FOREIGN PATENT DOCUMENTS 1174883 9/1984 Canada .

*Primary Examiner*—David H. Brown

[57] ABSTRACT

The invention is a blank firing attachment for use on a gas operated automatic rifle or light machine gun. The device restricts the exit of gases from the rifle barrel when a blank cartridge is fired, thus retaining sufficient gas pressure in the barrel to actuate the rifle's automatic firing mechanism and permit blank cartridges to be fired automatically or semiautomatically. The device has a body adapted to be attached to the muzzle compensator of a rifle and a stem having an axial cavity. The stem is adapted to seal against the inner bore of the compensator.

4 Claims, 1 Drawing Sheet

BLANK FIRING ATTACHMENT

FIELD OF THE INVENTION

The invention is a device for use on rifles or light machine guns to enable them to fire automatically or semiautomatically when they are used for firing blank cartridges.

BACKGROUND OF THE INVENTION

Some types of gas operated rifles or light machine guns have an automatic firing mechanism which is actuated by the pressure waves created by an ignited cartridge and bullet as the bullet travels down the rifled barrel. The automatic firing mechanism loads the next cartridge to be fired into the breach of the rifle. In such rifles or light machine guns, the pressure waves travel through a gas system connecting the barrel and the loading mechanism. However, when a blank cartridge is fired there is no bullet to create the proper pressure-time relationship needed by the rifle or light machine gun in order to function in an automatic or semi-automatic mode. If the exploding gases from the blank cartridge are permitted to exit the muzzle of the barrel without proper restriction, the pressure-time relationship in the barrel and gas system will not match the energy requirements needed to make the automatic firing mechanism function. The rifle or light machine gun will accordingly not operate automatically when firing blank cartridges. To create the required pressure wave and achieve automatic firing, it is necessary to restrict the escape of gases from the muzzle of the rifle or light machine gun.

SUMMARY OF THE INVENTION

The invention is a device, referred to as a blank firing attachment, which attaches to automatic or semi-automatic rifles and light machine guns to restrict the escape of the gases produced by firing a blank cartridge, thus actuating the automatic firing mechanism and permitting the automatic or semiautomatic firing of blank cartridges. The invention will allow for proper function of the automatic firing mechanisms of: the M16 family of weapons which includes but is not limited to rifles designated as M16, M16A1, M16A2, AR15, AR15A2, C7, C7A1, C8 carbines and other versions; the MINIMI family of weapons which includes but is not limited to light machine guns designated C9, C9A1 and M249 and other versions; and any alternative configuration of weapon that could be used to practice the present invention.

According to an embodiment of the invention, there is provided a blank firing attachment for use on an automatic or semi-automatic rifle or light machine gun of the type having a barrel, a muzzle compensator or flash eliminator affixed to the forward end of the barrel and an automatic firing mechanism actuated by gas pressure in the barrel caused by firing a live bullet. The attachment comprises: (a) a body adapted to be attached to the muzzle compensator; and (b) a stem attached to the body, the stem having a forward end, a rear end, an axial cavity open at the forward end and a gas exhaust port leading from the cavity to the outside. The stem is insertable into the forward end of the muzzle compensator to form a partially sealed chamber open through the gas exhaust port, whereby sufficient gas pressure is retained in the barrel after a blank round is fired to actuate the automatic firing mechanism.

The blank firing attachment attaches quickly to a rifle or light machine gun without tools, without the need to modify the rifle and without damage to the rifle or muzzle compensator or flash eliminator. The attachment can be quickly removed without tools to return the rifle or light machine gun to normal firing.

BRIEF DESCRIPTION OF THE DRAWINGS

In drawings which illustrate the preferred embodiment of the invention.

DETAILED DESCRIPTION OF THE PREFERRED EMBODIMENT

Figure 1:
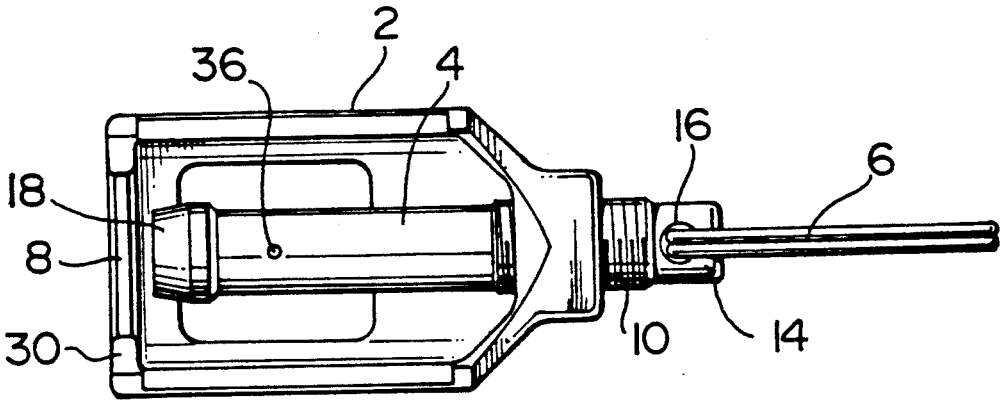
FIG. 1 is an elevation view of the blank firing attachment.
Figure 2:
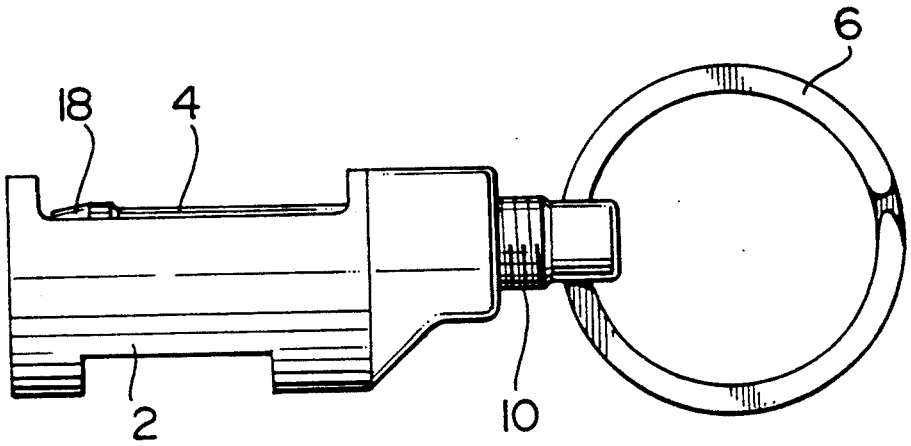
FIG. 2 is an elevation view of the blank firing attachment rotated axially 90° from the view of FIG. 1.

The preferred embodiment of the blank firing attachment is for use on type C7 and C8 M-16 rifles and on type C9 rifles. Referring to FIGS. 1 and 2, the blank firing attachment comprises a body 2, stem 4 and split ring 6. Stem 4 has a threaded portion 10 which engages with threaded bore 12 (shown in FIG. 3) of body 2, permitting stem 4 to be advanced and retracted through bore 12 by rotating stem 4. Split ring 6 is affixed through orifice 16 in the rear end 14 of stem 2 to provide a convenient handgrip to enable the stem 4 to be rotated.

Figure 3:
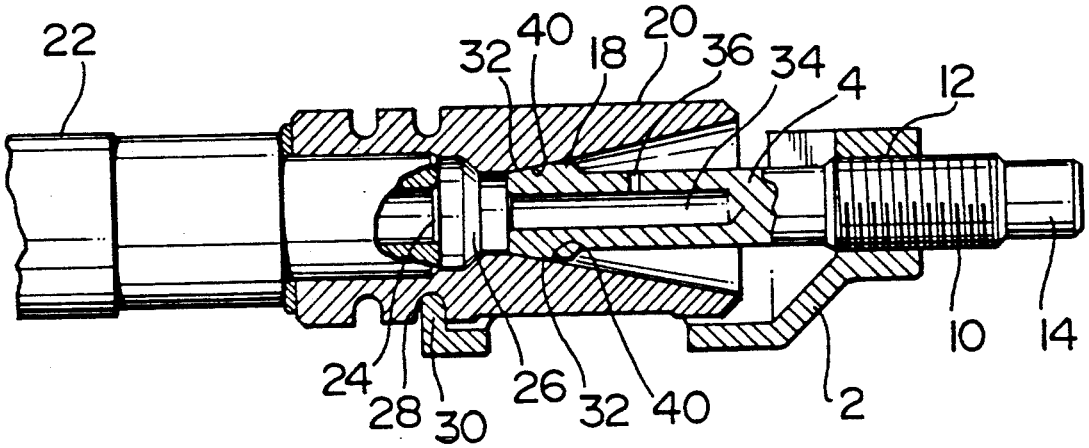
FIG. 3 is a view partially in section of the blank firing attachment mounted on the muzzle compensator of an automatic rifle.

Referring to FIG. 3, stem 4 has an axial cavity 34 open at the forward end 18 of the stem. Gas exhaust port 36 in the side of stem 4 provides an opening from cavity 34 to the outside.

Body 2 is in the general form of a half cylinder, open on one side and configured to permit convenient attachment to a muzzle compensator. Body 2 has flange 30 at its forward end to engage with a muzzle compensator as described below. A muzzle compensator, also referred to in the art as a flash eliminator, is a known device affixed to the muzzle of an automatic rifle to control the recoil and flashing that result from firing live bullets. In this specification and the appended claims, the term muzzle compensator is used for convenience, and includes flash eliminators. As shown in FIG. 3, muzzle compensator 20 is affixed to the muzzle end of gun barrel 22, with muzzle 24 opening into axial passage 26 of muzzle compensator 20. When the blank firing attachment is not mounted on the muzzle compensator, axial passage 26 is open to the outside to permit the exit of bullets from the rifle. The blank firing attachment is attached to muzzle compensator 20 by the steps of partially retracting stem 4 through bore 12 in body 2, engaging flange 30 of body 2 in groove 28 of compensator 20 and then advancing stem 4 through bore 12 until walls 40 of forward end 18 of stem 4 abut inner wall 32 of muzzle compensator 20. Inner wall 32 and walls 40 of stem 4 have matching 20° tapers which engage to form a seal. With the blank firing attachment in position on the muzzle compensator, a chamber is formed at the end of muzzle 24 comprising (a) the portion of axial passage 26 between muzzle 24 and stem 4 and (b) cavity 34 in stem 4. This limits the exit of gases from the muzzle of the weapon, permitting only the restricted release of gases to the outside through gas exhaust port 36.

In operation, when a blank cartridge is fired, the resulting gas pressure is confined by the blank firing attachment sufficiently that the pressure in the barrel actuates the automatic firing mechanism (not illustrated) of the rifle or light machine gun, thus permitting the automatic firing of blank cartridges. Gas exhaust orifice 36 permits gas to vent from the barrel, providing the firing sound desired when firing blank cartridges.

In the preferred embodiment, stem 4 is 2.30 inches long, cavity 34 is 0.875 inches deep and 0.140±0.003 inches in diameter; gas exhaust port 36 is 0.055±0.002 inches in diameter and 0.500 inches from the forward end of stem 4. Stem 4 is constructed of ASTM A331 Grade 4140 cold finished steel, in order to withstand the corrosive gases, and consequent erosion of metal, produced when firing blanks.

The preferred embodiment of the invention has been described above, but it will be apparent to a reader skilled in the art that alternative configurations could be used to practice the present invention. All such configurations are within the scope of the invention, which is defined in the appended claims.

What is claimed is:

1. A blank firing attachment for use on a gas operated automatic rifle or light machine gun of the type having a barrel, a muzzle compensator affixed to the forward end of the barrel and an automatic firing mechanism actuated by gas pressure in the barrel caused by firing a bullet, comprising:

a) a body adapted to be attached to said muzzle compensator, said body being generally half cylindrical and having a flange at its forward end for engagement with a groove in said muzzle compensator;

b) a stem attached to said body, said stem having a forward end, a rear end, an axial cavity open at said forward end and a gas exhaust port leading from said cavity, said forward end of said stem having a tapered sealing surface and being insertable into the forward end of said muzzle compensator, whereby said tapered sealing surface seals against a mating tapered internal wall of said muzzle compensator to form a partially sealed chamber open through said gas exhaust port, whereby sufficient gas pressure is retained in said barrel after a blank round is fired to actuate said automatic firing mechanism of said rifle.

2. A blank firing attachment in accordance with claim 1 wherein said stem is attached to said body by interengaging screw threads on the exterior of said stem and the interior of a bore in said body.

3. A blank firing attachment in accordance with claim 1 further comprising a ring attached to said rear end of said stem for threadably turning said stem.

4. A blank firing attachment in accordance with claim 1 wherein said stem is made of ASTM A331 Grade 4140 cold finished steel.

* * * * *